US005964448A

United States Patent [19]

Kiger

[11] Patent Number: 5,964,448

[45] Date of Patent: Oct. 12, 1999

[54] GRAVITY ASSISTED ACCESS PLUG

[76] Inventor: Bobby G. Kiger, 5315 Delta Dr., Winston-Salem, N.C. 27104

[21] Appl. No.: 08/664,988

[22] Filed: Aug. 5, 1996

[51] Int. Cl.[6] ..... F16K 31/44

[52] U.S. Cl. ..... 251/216; 251/264; 137/559; 411/973

[58] Field of Search ..... 251/264, 351, 251/215, 216, 144; 137/556, 559; 411/169, 973; 138/89

[56] References Cited

U.S. PATENT DOCUMENTS

| | | | |
|---|---|---|---|
| 134,781 | 1/1873 | Williams | 411/973 |
| 172,805 | 1/1876 | Webster | 411/973 |
| 179,577 | 7/1876 | Latham | 411/973 |
| 477,720 | 6/1892 | Weber | 137/556 |
| 609,325 | 8/1898 | Boasso | 411/973 |
| 739,250 | 9/1903 | Woodbury | 411/973 |
| 985,269 | 2/1911 | McIntyre et al. | 411/973 |
| 2,385,381 | 9/1945 | Samiran | 137/556 |
| 3,879,013 | 4/1975 | Hajek, Jr. | 251/144 |
| 3,910,550 | 10/1975 | Nelson | 251/144 |
| 4,231,544 | 11/1980 | Balch . | |
| 4,503,934 | 3/1985 | Stephanus et al. | 251/215 |
| 4,560,143 | 12/1985 | Robinson . | |
| 4,592,448 | 6/1986 | Morris . | |
| 4,986,502 | 1/1991 | Ceroke . | |
| 5,086,522 | 2/1992 | Stofko, Sr. | 251/264 |
| 5,184,698 | 2/1993 | Coffenberry . | |
| 5,253,868 | 10/1993 | Baumann et al. | 273/80 R |
| 5,368,181 | 11/1994 | Myers | 251/216 |
| 5,579,815 | 12/1996 | Labonte | 251/351 |

*Primary Examiner*—Denise L. Ferensic
*Assistant Examiner*—John Ball

[57] ABSTRACT

An access plug is provided for use in oil pans, transmissions and other fluid containers of equipment and the like. The access plug is weight imbalanced along the longitudinal axis to prevent inadvertent rotational movement of the access plug as may occur from vibrational forces when the plug is not properly tightened. By designing the plug with such an imbalance, the plug will terminate its rotation as the weighted half reaches the lowermost point during removal rotation and will so remain, preventing complete removal and rapid fluid loss.

9 Claims, 3 Drawing Sheets

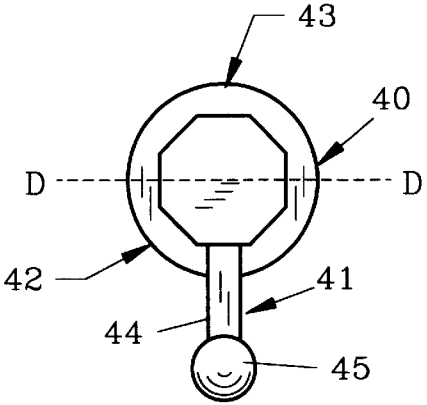
FIG. 9
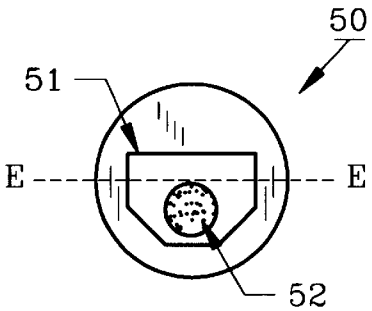
FIG. 10
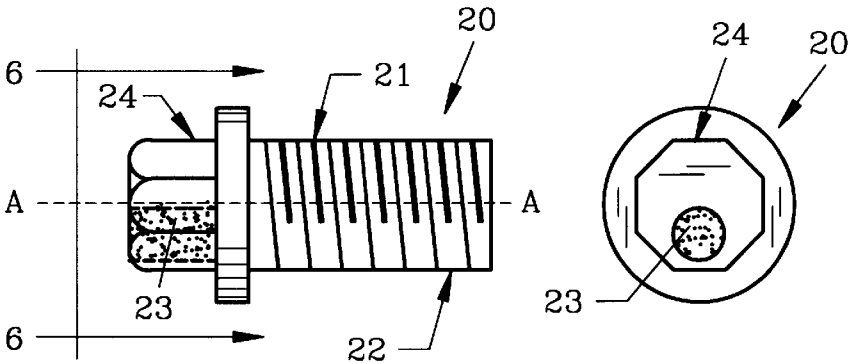
FIG. 6
FIG. 5
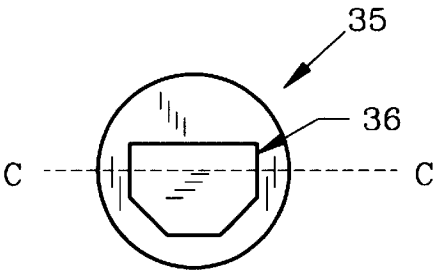
FIG. 8
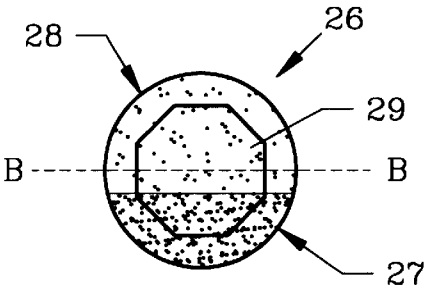
FIG. 7

GRAVITY ASSISTED ACCESS PLUG

BACKGROUND OF THE INVENTION

1. Field of the Invention

The invention herein pertains to access plugs and particularly to threaded access plugs which may be removed to drain fluids such as oils, fuels or lubricants from equipment such as pans, sumps, transmissions, pumps and the like.

2. Description of the Prior Art and Objectives of the Invention

Equipment owners in the past have suffered damage due to access plugs such as drain plugs being improperly tightened and torqued upon replacement, such as during oil changes. Inexperienced or unskilled attendants often partially replace an access plug, and forget to torque the plug to prevent it from loosening due to the vibrational forces created as the equipment is operated. Once an access plug sufficiently loosens, oil leakage occurs which left untightened over a period of time can cause engine failure. In certain equipment other fluid-containing plugs are also necessarily torqued to prevent inadvertent vibrational removal.

Various types of compression members and expandable plugs have been devised in the past to prevent inadvertent removal as by vibration, some of which require special tools, washers or steps to tighten, such as seen in U.S. Pat. Nos. 4,231,544, 4,986,502 and 5,184,698.

While such prior art devices have been somewhat successful in certain instances, there remains a need for a simple, inexpensive means for preventing inadvertent plug removal by the forces created by vibration during equipment operation.

Thus, with the disadvantages and complexities of prior art access plugs, the present invention was conceived and of its objectives is to provide a simple, inexpensive threaded access plug which will prevent inadvertent vibrational removal or excessive loosening, even if improperly tightened.

It is another objective of the present invention to provide an access plug which can be used in equipment oil pans or otherwise to securely contain fluid.

It is also an objective of the present invention to provide an access plug, which in the preferred form, includes a filler formed from a dense, heavy metal such as lead.

It is yet another objective of the present invention to provide a weight imbalanced access plug which can be easily substituted for a conventional plug yet which will prevent inadvertent rotational loosening movement due to its weight imbalance.

It is also an objective of the present invention to provide an access plug which can be easily used without special training or tools.

Various other objectives and advantages of the present invention will become apparent to those skilled in the art as a more detailed description is set forth below.

SUMMARY OF THE INVENTION

The aforesaid and other objectives are realized by providing a weight imbalanced access plug that is relatively heavier along one of its longitudinal halves to therefore prevent the threaded shank from rotating no more than one half turn under vibrational forces when the access plug is tightened in place, but perhaps not fully torqued. Thus, if the plug then loosens and rotates one half turn, some small amount of fluid may leak from the access plug location but the fluid will not usually rapidly leak therefrom to suddenly cause internal component damage. By making the access plug imbalanced, a casual, visual inspection can determine if the access plug is properly tightened since the visual indicator such as a colored mark or the like will serve as a warning by its position to the viewer. The access plug is useful in a standard threaded horizontal access opening or a vertical access opening which is converted to a horizontal threaded opening such as by the use of a conventional elbow.

BRIEF DESCRIPTION OF THE DRAWINGS

FIG. 5 features a side elevational view of one embodiment of the invention;

FIG. 6 pictures a front view of the embodiment as seen in FIG. 5 along lines 6—6;

FIG. 7 shows a front view of another embodiment of an access plug of the invention;

FIG. 8 depicts a front view of yet another embodiment of the invention;

FIG. 9 illustrates a front view of still another embodiment of the invention;

FIG. 10 shows the preferred embodiment of the access plug of the invention, and FIG. 11 demonstrates a view of a conventional vehicle oil sump with the new access plug as shown in FIG. 10 tightened in place.

DESCRIPTION OF THE PREFERRED EMBODIMENT

Figure 11:
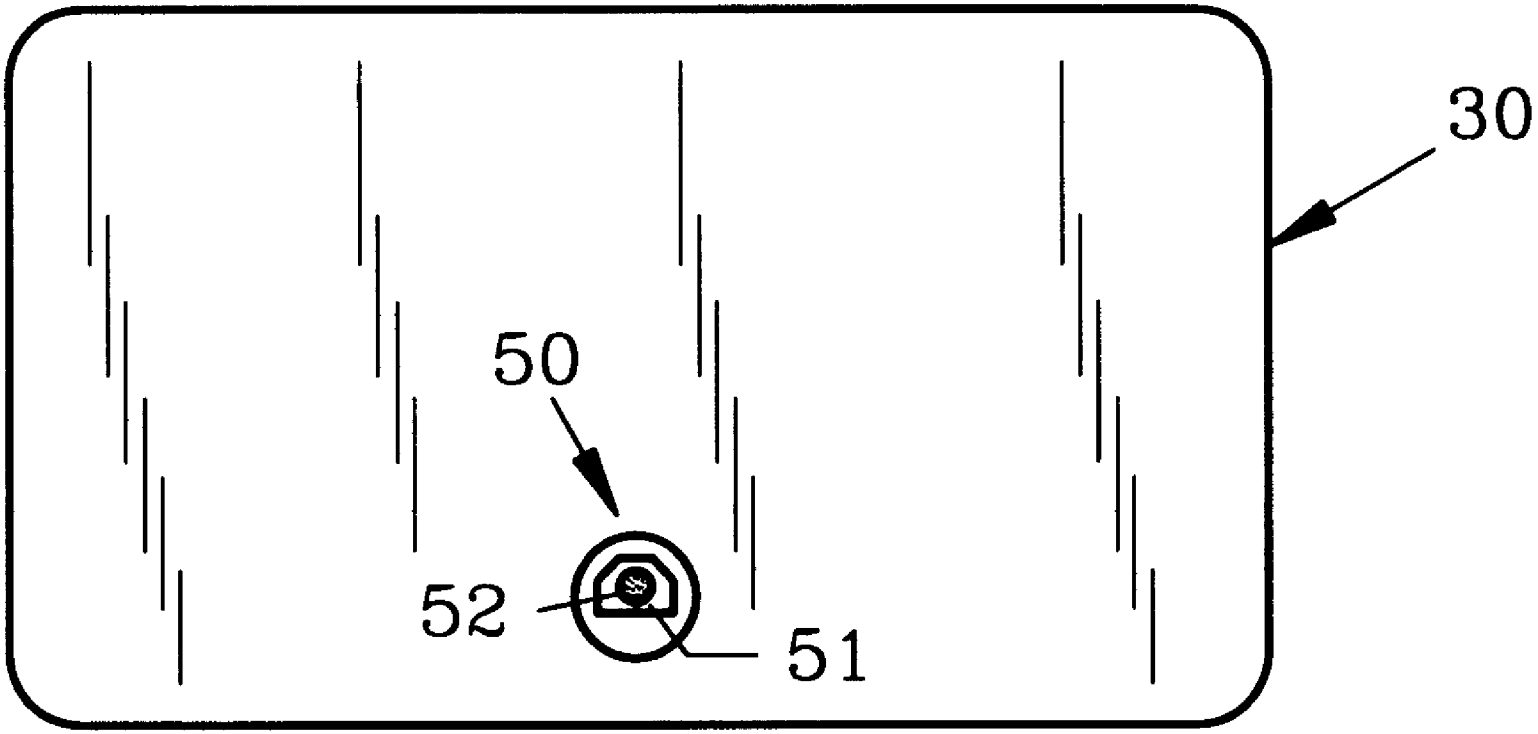

The preferred form of the invention is shown in FIGS. 10 and 11. As seen, the access plug therein is formed from metal and includes a threaded shank portion for tightening into an access plug opening such as on a equipment oil pan. The outer surface of the head defines generally a hexagon for gripping with a wrench. The plug is imbalanced in that the head has been ground or milled to remove the upper portion from a conventional octagon shaped plug and has been drilled in a longitudinal direction, and the channel formed thereby has been filled with a tungsten carbide alloy. The terminal or exposed end of the lead is colored such as by painting with a bright red paint to designate the filler position to an observer.

The method of using the preferred access plug comprises threadably tightening the plug into a horizontal oil pan drain opening with a socket or other wrench. The access plug may be tightened, whereupon the filler may be seen at the top of the plug as shown in FIG. 11, although the exact filler location upon tightening is not critical. Thereafter, if vibrational forces loosen the plug, the plug will rotate and the filler will turn to a bottom position as shown in FIG. 10. The imbalanced plug will not rotate further, that is, it will not rotate upon further vibration to threadably remove itself from the access plug opening since the gravitation forces acting on the imbalanced plug head, including the filler, are greater than the vibrational forces causing the plug to rotate.

Accordingly, the access plug will remain in its downwardly turned position, as shown in FIG. 10 causing loss of very little, if any, fluid from the oil pan.

DETAILED DESCRIPTION OF THE DRAWINGS AND OPERATION OF THE INVENTION

Figure 1:
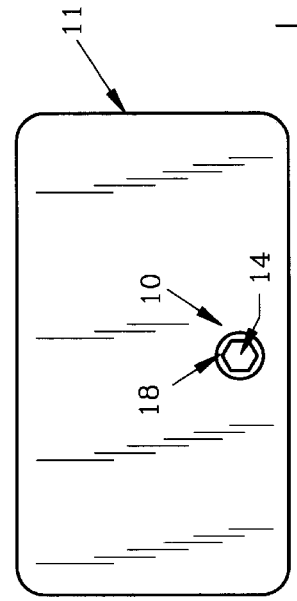
FIG. 1 illustrates a conventional equipment sump or oil pan having a standard threaded access plug horizontally positioned therein.
Figure 2:
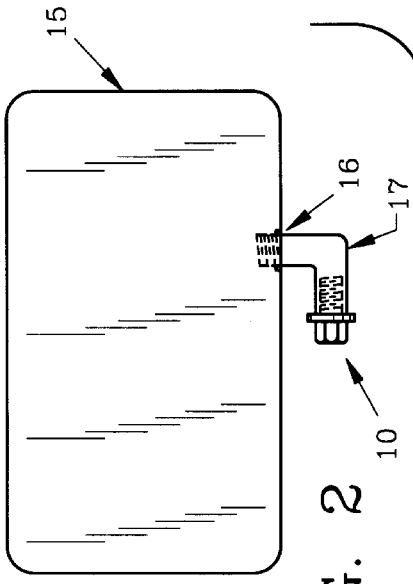
FIG. 2 PRIOR ART
FIG. 2 depicts another conventional oil sump with a vertical drain outlet utilizing an auxiliary elbow fitting.
Figure 3:
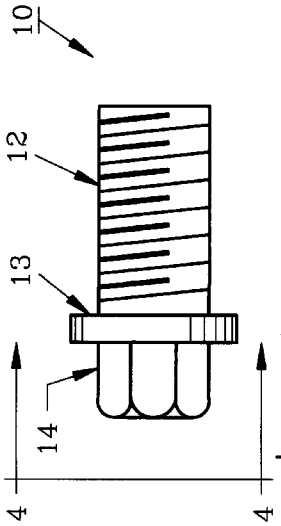
FIG. 3 shows an enlarged side view of a standard threaded oil pan access plug.
Figure 4:
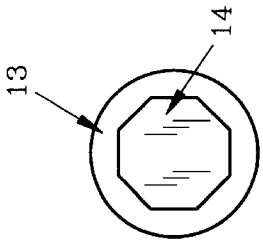
FIG. 4 PRIOR ART
FIG. 4 demonstrates a view of the access plug as shown in FIG. 3 along lines 4—4.

For a better understanding of the invention and its operation, turning now to the drawings, FIGS. 1–4 demonstrate use of prior art access plug 10 as threadably inserted into oil sump 11 of certain equipment (shown removed from the equipment for clarity purposes), such as a vehicle, generator motor, boat motor or otherwise. As seen in FIG. 3, conventional oil access plug 10 has a threaded shaft 12, an integral washer section 13 and a head 14. In FIG. 2 sump 15 is shown also removed from the equipment. Sump 15 has a vertical threaded access plug opening 16 which has been fitted with elbow 17 to allow access plug 10 to be used in a horizontal fashion. While in use, vibration from the operation of the equipment will oftentimes cause access plugs 10, as shown in FIGS. 1 and 2, to loosen and over a period of time, to vibrate completely from the threaded access plug opening. This usually occurs when the access plugs have not been properly tightened or "torqued" into place as may occur when an attendant, in changing oil, forgets to properly torque the access plugs after completing the oil change.

In order to prevent the access plugs from inadvertently working themselves loose and allowing the oil contained within sumps 11 and 15 from draining out and causing engine failure, various embodiments of imbalanced access plugs are presented to remedy this problem. Access plugs may be drain plugs or other types as are known in the industry. One embodiment of the invention is shown in FIG. 5 whereby access plug 20 is presented in a side view with line A—A dividing access plug 20 into upper longitudinal half 21 and lower longitudinal half 22. Head 24 defines an octagonal-shaped configuration for tool-gripping purposes. The lower half of head 24 of access plug 20 has been drilled and a material such as filler 23 consisting of lead or other dense material has been placed therein. This extra weight added to plug head 24 prevents plug 20 from rotating loose once it is installed to a finger-tight position within the oil plug opening such as opening 18 shown in FIG. 1. In operation, access plug 20 is placed in a horizontal plug opening and tightened as per usual. In the event the mechanic forgets to torque plug 20 on final tightening, plug 20 may tend to vibrate and loosen during equipment operation. Once plug 20 rotates to the position as shown in FIGS. 5 and 6, the vibrational forces thereafter are insufficient due to the weight imbalance to allow plug 20 to continue rotation. Therefore, access plug 20, for example, would remain only slightly loosened since it would have turned one half turn or less under the vibrational forces, and the weight of filler 23 would prevent further vibrational rotation, and excess fluid loss.

As seen in FIG. 11, access plug 50, the preferred form as seen in FIG. 10, is positioned within oil sump 30 with filler 52 shown tightened at the top of its rotational circle. Weight imbalanced plug 50 is divided into longitudinal halves along line E—E. Upon inspection, as seen in FIG. 11, an attendant could easily determine that plug 50 has not loosened since dense filler 52 of plug head 51 acts as a visual indicator for determining its location. Filler 52 may be painted red or another bright color for easy observation and determination of loosened plug 50.

In another embodiment, FIG. 7 demonstrates access plug 26 which has a heavier bottom half 27 and a lighter top half 28. Head 29 is octagonally shaped to define a tool-gripping surface as is standard in the art. Line B—B on FIG. 7 is shown as a dividing line between upper half 28 and lower half 27 of access plug 26 with the denser shading representing a heavier, denser material such as a heavy metal alloy.

In another embodiment, drain plug 35 is seen in FIG. 8. Here, a standard drain plug such as drain plug 10 shown in FIG. 3, has been modified whereby head 14 has been milled to remove a portion thereof along the upper half as seen by dividing line C—C. As it would be understood, head 36 of plug 35 is heavier below line C—C than above line C—C providing the needed imbalance.

In still another embodiment, as shown in FIG. 9, access plug 40 includes appendage 41 which provides weight to lower half 42 and, therefore, provides a weight imbalance along the longitudinal axis of plug 40. As presented, access plug 40 is divided into longitudinal halves along line D—D whereby upper half 43 is lighter in weight than lower half 42 due to the addition of appendage 41. Appendage 41 may consist of a metal bar 44 and a weighted sphere 45.

Various improvements and additions can be made to the invention as described herein and the drawings and embodiments presented are merely for explanatory purposes and are not intended to limit the scope of the appended claims. Also, the invention described is not limited to the designs shown or to recessed head plugs such as allen head, slotted head, Phillips head and others as are in common use.

I claim:

1. An access plug comprising: a threaded cylindrical shank, an imbalanced head, said head joined to said shank, said imbalanced head comprising a weighted portion, said weighted portion comprising a filler, said weighted portion to prevent vibrational removal of said plug.

2. The access plug of claim 1 wherein said filler comprises lead.

3. The access plug of claim 1 and including a visual indicator, said indicator affixed to said head, said indicator for designating the relative position of the access plug.

4. The access plug of claim 2 wherein said filler comprises dense material.

5. The access plug of claim 1 wherein said head defines tool gripping means.

6. In an access plug for horizontal positioning in a drain opening for removal and replacement during fluid exchange, the access plug having a head and a threadable shank for manipulation within the access opening, the improvement comprising:

milling said head to remove a portion thereof for gravitational action on the remaining portion.

7. The access plug of claim 6 further comprising a filler, said filler positioned in said remaining portion.

8. The access plug of claim 6 further comprising a visual indicator, said visual indicator affixed to said head.

9. An access plug comprising:

a) a threaded cylindrical shank;

b) a head, said head comprising an irregularly shaped polygon, said polygon for tool gripping, said polygon milled to remove a portion thereof; and c) a filler, said filler positioned in said polygon to thereby create an imbalanced head to prevent vibrational removal of said plug.

* * * * *